US007128120B2

(12) United States Patent
Orbeck et al.

(10) Patent No.: US 7,128,120 B2
(45) Date of Patent: Oct. 31, 2006

(54) ASSEMBLY OF SASHES FOR SLIDING GLASS DOORS

(76) Inventors: David Orbeck, 2039 W. Avenue J, Lancaster, CA (US) 93536; Mark Orbeck, 2039 W. Avenue J, Lancaster, CA (US) 93536

( * ) Notice: Subject to any disclaimer, the term of this patent is extended or adjusted under 35 U.S.C. 154(b) by 14 days.

(21) Appl. No.: 10/776,843

(22) Filed: Feb. 10, 2004

(65) Prior Publication Data

US 2005/0173079 A1 Aug. 11, 2005

(51) Int. Cl.
*E06B 3/32* (2006.01)

(52) U.S. Cl. ..... 160/89; 160/107; 49/63

(58) Field of Classification Search ..... 160/89, 160/101, 107, 118, 119, 167 R, 172 R, 214, 160/167 V; 49/61, 63, 116, 127
See application file for complete search history.

(56) References Cited

U.S. PATENT DOCUMENTS

| | | | | | |
|---|---|---|---|---|---|
| 106,196 | A | | 10/1877 | Boyden et al. | |
| 362,854 | A | | 5/1887 | Poppert | |
| 1,238,703 | A | | 8/1917 | Wendelken | |
| 1,344,529 | A | | 6/1920 | White | |
| 2,120,986 | A | | 6/1938 | Morris | |
| 2,970,642 | A | | 12/1958 | Parsons | |
| 2,957,211 | A | * | 10/1960 | Howard | 49/95 |
| 3,452,477 | A | * | 7/1969 | Sassano | 49/116 |
| 3,946,524 | A | | 3/1976 | Budich | |
| 3,991,518 | A | | 11/1976 | Ishihara | |
| 4,288,887 | A | * | 9/1981 | Johnson et al. | 16/105 |
| 4,341,254 | A | * | 7/1982 | Schaller et al. | 160/172 R |
| 4,411,111 | A | * | 10/1983 | Hosooka | 52/204.55 |
| 4,457,106 | A | | 7/1984 | Forquer | |
| 4,538,662 | A | * | 9/1985 | Tomita | 160/107 |
| 4,555,828 | A | * | 12/1985 | Matimura | 16/95 R |
| 4,602,456 | A | | 7/1986 | Tatro | |
| 4,877,076 | A | * | 10/1989 | Komori et al. | 160/107 |
| 5,390,454 | A | | 2/1995 | Coddens | |
| 5,957,186 | A | * | 9/1999 | Boswell | 160/201 |
| 6,213,187 | B1 | | 4/2001 | Hughes | |
| 6,336,247 | B1 | * | 1/2002 | Schnoor | 16/87.6 R |
| 6,497,072 | B1 | | 12/2002 | Fries | |
| 6,497,265 | B1 | * | 12/2002 | Davis et al. | 160/87 |
| 6,505,669 | B1 | * | 1/2003 | Lilie et al. | 160/371 |
| 6,860,064 | B1 | * | 3/2005 | Bakalar | 49/127 |

OTHER PUBLICATIONS

The Add-a-Room System of Window-Wall Construction, at least as old as 1917.

* cited by examiner

*Primary Examiner*—Blair M. Johnson
(74) *Attorney, Agent, or Firm*—Berliner & Associates

(57) ABSTRACT

An assembly of sashes containing investitures, such as venetian blinds and/or mesh screens, for application adjacent the inside surfaces of sliding glass doors. In one embodiment, the sashes are suspended from inner and outer tracks of a rail in sliding overlapping relationship. The rail can be secured to the underside of a header disposed along the inside width of the sliding glass doors.

4 Claims, 2 Drawing Sheets

ASSEMBLY OF SASHES FOR SLIDING GLASS DOORS

FIELD OF THE INVENTION

The invention relates generally to an assembly of sashes containing investitures such as venetian blinds and/or mesh screens.

BACKGROUND OF THE INVENTION

It has long been known to use various investitures, i.e., coverings or adornments, for windows such as various blinds (e.g., venetian blinds) and mesh screens. Blinds have generally been applied the inside of windows, i.e., adjacent the surface of the window facing into the house or other structure, as compared to the use of mesh screens which are generally applied to the outside of windows, i.e., adjacent the surface of the window facing away from the house or other structure. It has of course been known to apply screen doors to the outside of sliding glass doors. U.S. Pat. No. 2,970,642 describes rollingly supporting a screen using suspension bracket to move across the outside header of sliding glass doors. A modern version of sliding glass doors is shown in U.S. Pat. No. 6,497,072. It is also known to apply curtains and blinds, particularly with vertically hanging slats, to cover or adorn the insides of sliding glass doors.

A wide variety of sash configurations have also long been available to the public, generally containing windows, but also containing investitures such as venetian blinds and mesh screens. Various methods have long been devised to connect such sashes to windows. See, for example, U.S. Pat. Nos. 196,186, issued in 1877 which provides double windows with blinds and screens moving independently of each other. Other sashes are shown in U.S. Pat. Nos.: 362,854; 1,238,703; 1,344,529; 3,991,518; 4,457,106, 4,602,456; and 6,213,187. The disclosures of all the foregoing U.S. Pat. Nos.: 196,186; 362,854; 1,238,703; 1,344,529; 2,970,642; 3,991,518; 4,457,106, 4,602,456; 6,213,187; and 6,497,072 are incorporated herein by reference.

While the art dealing with such sashes has been well developed over many years, there has not been available a practical construction that enables one to apply one or more investitures adjacent the inside surface of sliding glass doors in such manner that they can be slid into or out of position.

SUMMARY OF INVENTION

The present invention provides an assembly of sashes, also called panels, containing investitures, such as venetian blinds and/or mesh screens, for application adjacent the inside surfaces of sliding glass doors. In one embodiment, the sashes are suspended from inner and outer tracks of a rail in sliding overlapping relationship. The rail can be secured to the underside of a header disposed along the inside width of the sliding glass doors. More particularly, a header extends along the inside width of the sliding glass doors. A rail is secured to the underside of the header formed with opposed upwardly turned flanges defining opposed inner and outer roller tracks, each track carrying a pair of rollers. The tops of generally rectangular sashes are each fitted with spaced apart suspension brackets connected to respective rollers carried by the roller tracks whereby the sashes are rollingly suspended from the track in sliding overlapping relationship.

Investitures are secured in the sashes. In one embodiment, the investitures are shutters. In another embodiment, the investitures are mesh screens. In still another embodiment, the investiture in one of the sashes is a shutter while the investiture in the other sash is a mesh screen. The shutters can be a blinds, such as venetian blinds.

DETAILED DESCRIPTION

Figure 1:
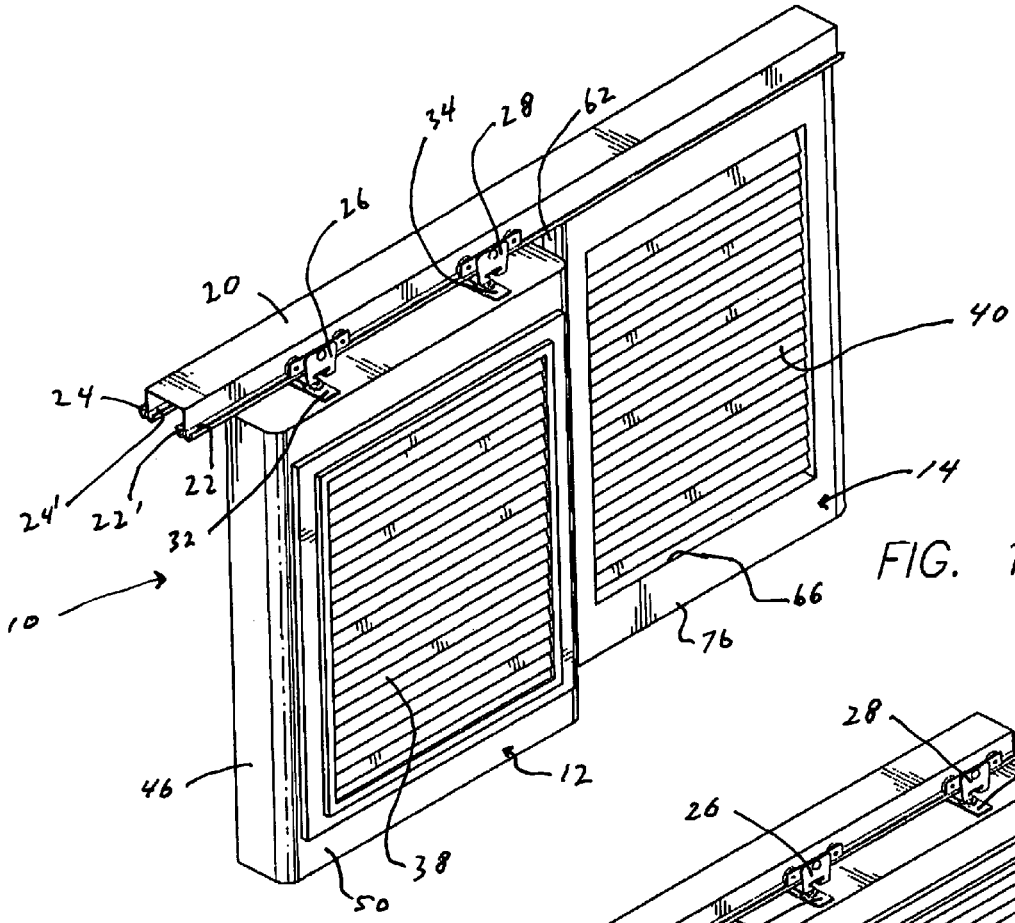
FIG. 1 is a perspective view of an assembly of sashes for application in accordance with one embodiment of the invention, in which the investitures are front and rear blinds.
Figure 2:
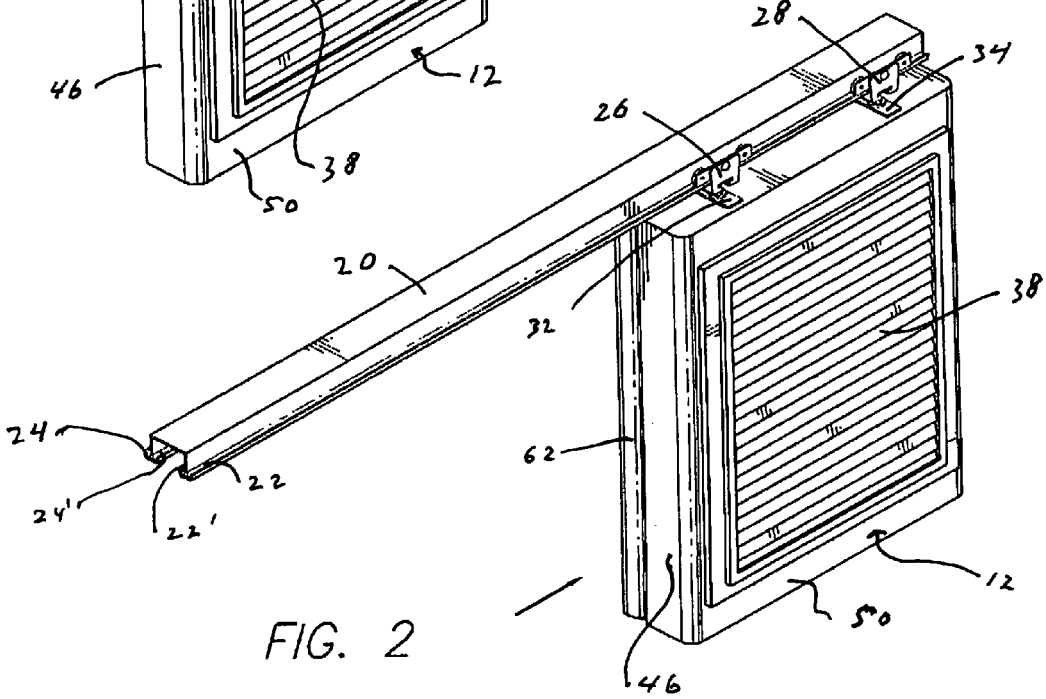
FIG. 2 is a perspective view of the front blinds of the assembly of FIG. 1.
Figure 3:
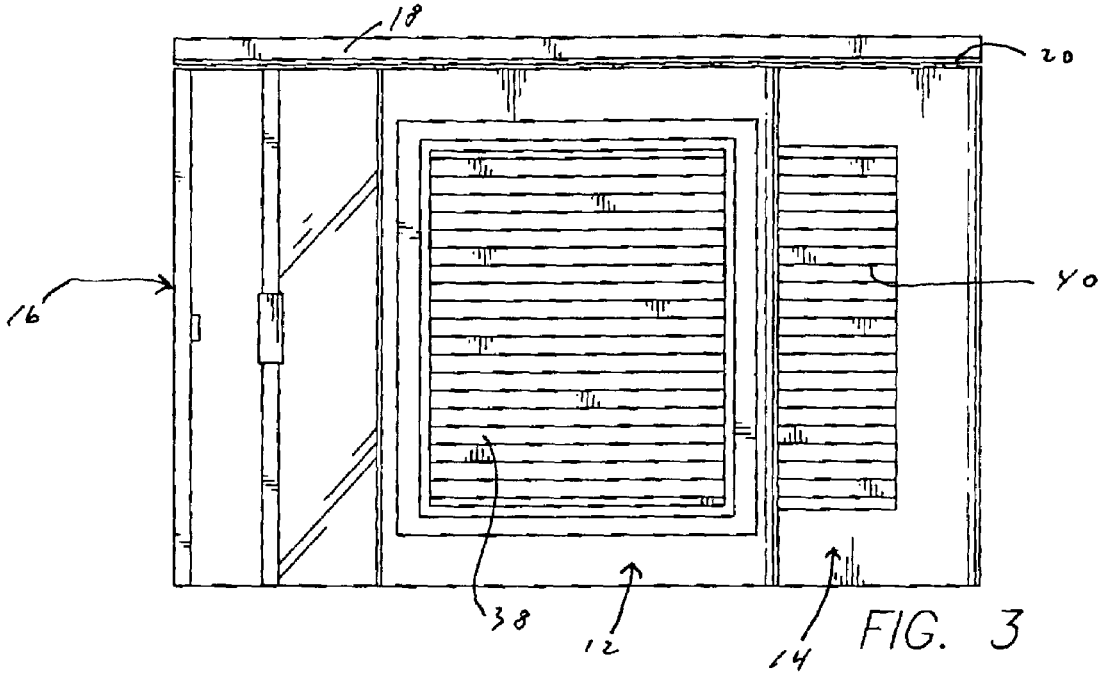
FIG. 3 is a front elevational view of the assembly of front and rear blinds hung in front of sliding glass doors.
Figure 4:
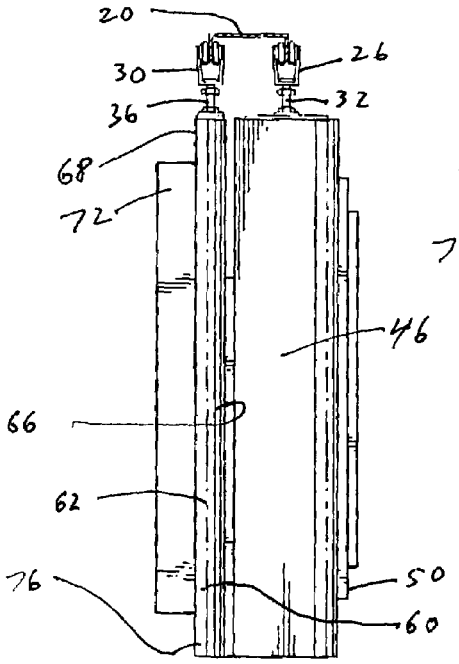
FIG. 4 is a left elevational view of assembly of blinds of FIG. 1 when drawn together.

The invention is shown in FIGS. 1–5, and comprises an assembly 10 of front and rear sashes, respectively 12 and 14, for application adjacent the inside surfaces of a set of sliding glass doors 16 along the top of which extends a header 18 (FIG. 3). For purposes of description of the invention, and as indicated above, reference to "inside surfaces" with respect to the sliding glass doors means adjacent the surface of the sliding glass doors facing into the house or other structure. As seen more clearly in FIGS. 1 and 2, a rail 20 is secured to the underside of the header 18 and formed with opposed upwardly turned flanges defining two sets of opposed front and rear roller tracks, respectively 22, 22' and 24, 24'. Front roller mechanisms 26 and 28 (FIGS. 1 and 2) are carried on the front tracks 22, 22'. Similarly, and referring to FIGS. 4 and 5, rear roller mechanisms (only one of which, 30, is shown) are carried on the rear tracks 24,24'.

The front and rear sashes 12 and 14 are rollingly suspended respectively from the front and rear tracks 22,22' and 24,24' in sliding overlapping relationship. A pair of spaced apart front suspension brackets 32 and 34 are screwed onto the top of the front sash 12 adjacent its sides and engage the respective roller mechanisms 26 and 28. Similarly, and again referring to FIGS. 4 and 5, a pair of spaced apart rear suspension brackets (only one of which, 36, is shown) are screwed onto the top of the rear sash 14 adjacent its sides and engage the respective roller mechanisms, e.g., 30. As shown more clearly in FIGS. 1, 2, 4 and 5, in this particular implementation, each roller mechanism is formed with four rollers, two each on opposite sides of the respective bracket 32, 34, 36. Referring to the tracks 22, 22' and the roller mechanism 26 as illustrative, two of the four rollers in the roller mechanism 26 are carried on track 22 and the other two rollers are carried on track 22'. The other roller mechanisms are similarly arranged. It will be appreciated that the specific roller mechanisms and brackets are used for illustration only and other, simpler or more complex, roller mechanisms and brackets can be used. Stops can be provided to limit lateral movement of the roller mechanisms on the tracks.

Figure 5:
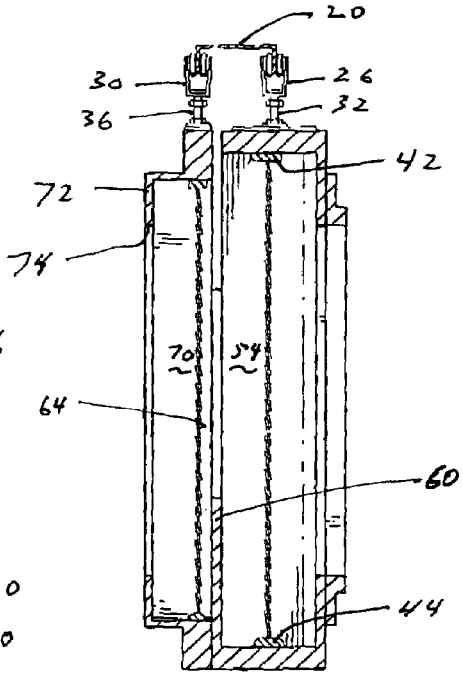
FIG. 5 is a cross-sectional view of the assembly of blinds of FIG. 4.

Investitures for the sliding glass doors 16 are secured in the front and rear sashes 12 and 14. In the illustrated embodiment, the investitures are shutters, more particularly blinds, even more particularly venetian blinds, respectively 38 and 40. The blinds 38 and 40 are secured in the sashes by any suitable means, e.g., by screwing top and bottom blind headers, respectively 42 and 44, (FIG. 5). The blinds can be fixed as shown, the slats can be individually suspended in flexible ladder suspension harnesses (e.g., as in U.S. Pat. No. 4,602,456) or can have rotatable slats moved by means of a tilt bar (e.g., as in U.S. Pat. No. 6,213,187), or can have any of a number of other known configurations. Alternatively, both sashes can be fitted with a mesh screen, or one can be fitted with a mesh screen and the other with a blind.

While in its general form the invention is as described above, there are advantages to having the sashes with specific configurations as will now be described. Referring to the front sash 12, it is generally rectangular having side walls 46 and 48 between front and rear sides, respectively 50 and 52 defining a generally rectangular front sash opening 54 of predetermined height and width and a predetermined depth from the front side to the rear side of the front sash 12. A generally rectangular frame 56 on the front side of the front sash 12 defines a generally rectangular opening 58 of predetermined height and width smaller than the front sash opening 54. A three sided frame 60 on the rear side of the front sash 12 covers the bottom and part of the sides of the front sash opening 54 and together with the front frame 56 serves as a pocket for receipt of the investiture, e.g., the blind 38 or a mesh screen.

Referring to the rear sash 14, it is generally rectangular having side walls 62 and 64 between front and rear sides, respectively 66 and 68 defining a generally rectangular rear sash opening 70 of predetermined height and width and a predetermined depth from the front side to the rear side of the front sash 14. A generally rectangular frame 72 on the rear side of the rear sash 14 defines a generally rectangular opening 74 of predetermined height and width smaller than the rear sash opening 70. The front side of the rear sash 14 is fitted with a generally rectangular frame 76 extending the margins of the rear sash whereby the rear sash 14 has substantially the same outer dimensions as the outer dimensions of the front sash 12.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments described in the specification. As one of ordinary skill in the art will readily appreciate from the disclosure of the present invention, means presently existing or later to be developed that perform substantially the same function or achieve substantially the same result as the corresponding embodiments described herein may be utilized according to the present invention. Accordingly, the appended claims are intended to include such means within their scope.

The invention claimed is:

1. An assembly of sashes containing investitures for application adjacent the inside surfaces of sliding glass doors, comprising:

a header and sliding glass doors in combination with the assembly, the header extending along the inside width of the sliding glass doors;

a rail secured to the underside of the header formed with opposed upwardly turned flanges defining opposed inner and outer roller tracks, each track carrying a pair of rollers;

a generally rectangular front sash having side walls between front and rear sides providing a generally rectangular front sash opening of predetermined height and width and a predetermined depth from the front side to the rear side of the front sash, the height and width of the front sash opening being smaller than the height and width of the investiture to be secured therein;

a generally rectangular front frame on the front side of the front sash defining a generally rectangular opening of predetermined height and width smaller than the front sash opening;

a three sided frame on the rear side of the front sash covering the bottom and part of the sides but not the top of the front sash opening;

a pair of spaced apart suspension brackets on top of the front sash connected to the pair of rollers carried by the outer roller track whereby the front sash is rollingly suspended from the outer track;

a generally rectangular rear sash having side walls between front and rear sides defining a generally rectangular rear sash opening of predetermined height and width and a predetermined depth from the front side to the rear side of the rear sash, the height, width and depth of the rear sash opening enabling the rear sash to enclose an investiture;

a generally rectangular frame on the rear side of the rear sash defining a generally rectangular opening of predetermined height and width smaller than the rear sash opening;

a generally rectangular frame on the front side of the rear sash extending the margins of the rear sash whereby the rear sash has substantially the same outer dimensions as the outer dimensions of the front sash;

a pair of spaced apart suspension brackets on top of the rear sash connected to the pair of rollers carried by the inner roller track whereby the rear sash is rollingly suspended from the inner track in sliding overlapping relationship with the front sash;

investitures for the sliding glass doors secured in the front and rear sashes wherein the investiture in one of the sashes is a shutter and the investiture in the other sash is a mesh screen.

2. An assembly of sashes containing investitures for application adjacent the inside surfaces of sliding glass doors, comprising:

a header in combination with the assembly, extending along the inside width of the sliding glass doors;

a rail secured to the underside of the header formed with opposed upwardly turned flanges defining opposed inner and outer roller tracks, each track carrying a pair of rollers;

a generally rectangular front sash having side walls between front and rear sides providing a generally rectangular front sash opening of predetermined height and width and a predetermined depth from the front side to the rear side of the front sash, the height and width of the front sash opening being smaller than the height and width of the investiture to be secured therein;

a generally rectangular front frame on the front side of the front sash defining a generally rectangular opening of predetermined height and width smaller than the front sash opening;

a three sided frame on the rear side of the front sash covering the bottom and part of the sides but not the top of the front sash opening;

a pair of spaced apart suspension brackets on top of the front sash connected to the pair of rollers carried by the outer roller track whereby the front sash is rollingly suspended from the outer track;

a generally rectangular rear sash having side walls between front and rear sides defining a generally rectangular rear sash opening of predetermined height and width and a predetermined depth from the front side to the rear side of the rear sash, the height, width and depth of the rear sash opening enabling the rear sash to enclose an investiture;

a generally rectangular frame on the rear side of the rear sash defining a generally rectangular opening of predetermined height and width smaller than the rear sash opening;

a generally rectangular frame on the front side of the rear sash extending the margins of the rear sash whereby the rear sash has substantially the same outer dimensions as the outer dimensions of the front sash;

a pair of spaced apart suspension brackets on top of the rear sash connected to the pair of rollers carried by the inner roller track whereby the rear sash is rollingly suspended from the inner track in sliding overlapping relationship with the front sash;

investitures for the sliding glass doors secured in the front and rear sashes in which the investiture in one of the sashes is a blind and the investiture in the other sash is a mesh screen.

3. The assembly of claim 2 in which the shutter is a blind.

4. The assembly of claim 3 in which the blind is a Venetian blind.

* * * * *